US009528347B2

(12) United States Patent
Vick, Jr. et al.

(10) Patent No.: US 9,528,347 B2
(45) Date of Patent: Dec. 27, 2016

(54) ELETRIC SUBSURFACE SAFETY VALVE WITH INTEGRATED COMMUNICATIONS SYSTEM

(75) Inventors: James Dan Vick, Jr., Dallas, TX (US); Bruce Edward Scott, McKinney, TX (US); Joseph Steven Grieco, McKinney, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 86 days.

(21) Appl. No.: 14/408,136

(22) PCT Filed: Jul. 10, 2012

(86) PCT No.: PCT/US2012/046015

§ 371 (c)(1),
(2), (4) Date: Dec. 15, 2014

(87) PCT Pub. No.: WO2014/011148

PCT Pub. Date: Jan. 16, 2014

(65) Prior Publication Data

US 2015/0123808 A1 May 7, 2015

(51) Int. Cl.
*G01V 3/00* (2006.01)
*E21B 34/16* (2006.01)
(Continued)

(52) U.S. Cl.
CPC ..... *E21B 34/16* (2013.01); *E21B 34/066* (2013.01); *E21B 47/12* (2013.01); *E21B 47/122* (2013.01); *E21B 47/14* (2013.01)

(58) Field of Classification Search
CPC ..... E21B 34/16; E21B 47/12; E21B 34/066; E21B 47/122; E21B 47/14
See application file for complete search history.

(56) References Cited

U.S. PATENT DOCUMENTS 4,082,147 A 4/1978 Wolff et al.
4,619,320 A 10/1986 Adnyana et al.
(Continued)

OTHER PUBLICATIONS

Data Acquisition Services, retrieved from the internet at http://www.halliburton.com/public/ts/contents/Books_and_Catalogs/web/TestTools/03_DAS.pdf, at least as early as Feb. 20, 2012.
(Continued)

*Primary Examiner* — Erin File
(74) *Attorney, Agent, or Firm* — Kilpatrick Townsend & Stockton LLP

(57) ABSTRACT

Certain aspects and features are directed to an electric subsurface safety valve including an integrated communications system that can be disposed in a wellbore. The electric subsurface safety valve can include a body adapted to be coupled to a cable, a communications system disposed in the body, and a closure mechanism. The body can be disposed within the wellbore. The communications system can include one or more transceiving devices and a processing device. The transceiving devices can communicate signals via the cable to a rig at the surface and can wirelessly communicate signals to target tool in the well system. The processing device can process signals received by the one or more transceiving devices for communication via the cable. The closure mechanism can be positioned in a passageway defined by the wellbore and can control a flow of fluid to through the passageway.

32 Claims, 11 Drawing Sheets

(51) Int. Cl.

| | |
|---|---|
| ***E21B 47/12*** | (2012.01) |
| ***E21B 47/14*** | (2006.01) |
| ***E21B 34/06*** | (2006.01) |

(56) References Cited

U.S. PATENT DOCUMENTS

| | | | | |
|---|---|---|---|---|
| 4,649,993 | A | 3/1987 | Going | |
| 5,008,664 | A | 4/1991 | More et al. | |
| 5,355,952 | A | 10/1994 | Meynier | |
| 5,526,883 | A | 6/1996 | Breaux | |
| 5,706,892 | A * | 1/1998 | Aeschbacher, Jr. | E21B 17/028 166/66 |
| 5,868,201 | A | 2/1999 | Bussear et al. | |
| 5,942,990 | A | 8/1999 | Smith et al. | |
| 6,075,461 | A | 6/2000 | Smith | |
| 6,177,882 | B1 | 1/2001 | Ringgenberg et al. | |
| 6,199,629 | B1 | 3/2001 | Shirk et al. | |
| 6,218,959 | B1 | 4/2001 | Smith | |
| 6,269,874 | B1 | 8/2001 | Rawson et al. | |
| 6,557,642 | B2 | 5/2003 | Head | |
| 6,684,952 | B2 | 2/2004 | Brockman et al. | |
| 6,799,633 | B2 | 10/2004 | McGregor | |
| 6,873,267 | B1 | 3/2005 | Tubel et al. | |
| 6,958,704 | B2 | 10/2005 | Vinegar et al. | |
| 7,063,143 | B2 | 6/2006 | Tilton et al. | |
| 7,224,288 | B2 | 5/2007 | Hall et al. | |
| 7,228,902 | B2 | 6/2007 | Oppelt | |
| 7,231,971 | B2 | 6/2007 | McCalvin | |
| 7,252,152 | B2 | 8/2007 | LoGiudice et al. | |
| 7,303,029 | B2 | 12/2007 | Hall et al. | |
| 7,556,097 | B2 | 7/2009 | Heller et al. | |
| 7,640,993 | B2 | 1/2010 | Head | |
| 7,665,518 | B2 | 2/2010 | Bane et al. | |
| 7,694,740 | B2 | 4/2010 | Mailand et al. | |
| 8,056,619 | B2 | 11/2011 | Patel et al. | |
| 8,087,461 | B2 | 1/2012 | Fitzgerald | |
| 2002/0060072 | A1 * | 5/2002 | Cong | E21B 43/116 166/297 |
| 2004/0206503 | A1 * | 10/2004 | Bell | E21B 43/116 166/297 |
| 2005/0087368 | A1 * | 4/2005 | Boyle | E21B 17/023 175/57 |
| 2005/0284639 | A1 | 12/2005 | Reimert | |
| 2006/0151179 | A1 | 7/2006 | Boyadjieff et al. | |
| 2006/0157240 | A1 | 7/2006 | Shaw et al. | |
| 2007/0000667 | A1 | 1/2007 | MacKenzie et al. | |
| 2008/0066961 | A1 * | 3/2008 | Aivalis | E21B 4/02 175/50 |
| 2008/0257548 | A1 | 10/2008 | Shaw et al. | |
| 2009/0289808 | A1 | 11/2009 | Prammer | |
| 2010/0000729 | A1 * | 1/2010 | Alberty | E21B 47/00 166/254.1 |
| 2010/0224360 | A1 | 9/2010 | MacDougall et al. | |
| 2010/0300678 | A1 | 12/2010 | Patel et al. | |
| 2010/0300696 | A1 | 12/2010 | McCalvin et al. | |
| 2011/0048692 | A1 | 3/2011 | Ross et al. | |
| 2011/0114309 | A1 * | 5/2011 | Bloemenkamp | G01V 3/24 166/250.01 |
| 2011/0186303 | A1 | 8/2011 | Scott et al. | |
| 2011/0308807 | A1 | 12/2011 | Spencer | |
| 2012/0304757 | A1 * | 12/2012 | Fujisawa | E21B 49/081 73/152.27 |
| 2013/0110402 | A1 * | 5/2013 | Godager | E21B 47/122 702/7 |

OTHER PUBLICATIONS

International Patent Application No. PCT/US2012/046015 , International Search Report and Written Opinion mailed Feb. 26, 2013, 11 pages.

* cited by examiner

ELETRIC SUBSURFACE SAFETY VALVE WITH INTEGRATED COMMUNICATIONS SYSTEM

CROSS-REFERENCE TO RELATED APPLICATIONS

This is a U.S. national phase under 35 U.S.C. 371 of International Patent Application No. PCT/US2012/046015, titled "Electric Subsurface Safety Valve with Integrated Communications System" and filed Jul. 10, 2012, the entirety of which is incorporated herein by reference.

TECHNICAL FIELD OF THE INVENTION

The present invention relates generally to devices for communicating with intelligent tools in a subterranean formation and, more particularly (although not necessarily exclusively), to an electric subsurface safety valve including an integrated communications system.

BACKGROUND

An intelligent tool operating in a well system, such as an oil or gas well for extracting fluids that can include petroleum oil hydrocarbons from a subterranean formation, can include a communications system for communicating with the control system. The range of the communications system can be less than the depth at which the intelligent tool is used. An intelligent tool may operate at a depth that is greater than the range of the intelligent tool's communications system. The intelligent tool may communicate with a control system at the surface via signal repeaters coupled to the casing string. Signal repeaters that may be powered by a battery or other local power source can have an operational lifespan of several months.

Systems and methods are desirable that are usable to communicate with intelligent tools in a well system.

SUMMARY

Certain aspects and features of the present invention are directed to an electric subsurface safety valve including an integrated communications system that can be disposed in a wellbore that is through a fluid-producing formation. The electric subsurface safety valve can include a body, a communications system, and a closure mechanism. The body can be adapted to be coupled to a cable. The body can be disposed within the wellbore. The communications system can be disposed in the body. The communications system can include one or more transceiving devices and a processing device. The one or more transceiving devices can be configured to communicate signals via the cable. The one or more transceiving devices can also be configured to communicate signals wirelessly. The processing device can be configured to process signals received by the one or more transceiving devices for communication via the cable. The closure mechanism can be positioned in a passageway defined by the wellbore. The closure mechanism can be configured to prevent a flow of fluid to a portion of the passageway that is closer to a surface of the wellbore than the closure mechanism.

These illustrative aspects and examples are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
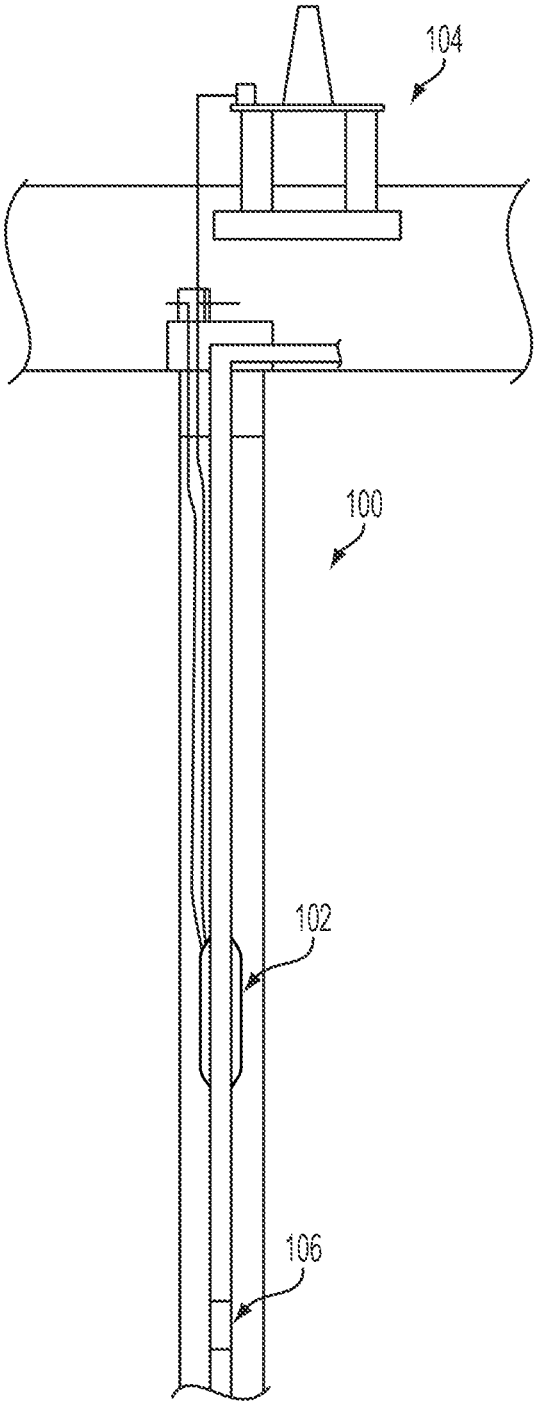
FIG. 1 is a block diagram of a rig at the surface of a well system communicating with a target tool via an electric subsurface safety valve with an integrated communications system according to one aspect of the present invention.

Certain aspects and features of the present invention are directed to an electric subsurface safety valve ("ESSSV") with an integrated communications system. The ESSSV can be disposed in a wellbore that is through a fluid-producing formation. The communications system of the ESSSV can receive power from and communicate with a rig at the surface via the cable. The ESSSV can communicate with one or more intelligent tools in the wellbore using the communications system. Integrating the communications system with the ESSSV can reduce the distance over which signals must be communicated from a rig at the surface of the wellbore to a target intelligent tool operating in the wellbore.

The ESSSV can include a body, a closure mechanism, and a communications system disposed within the body. The body can be coupled to a cable extending to a rig at the surface of the wellbore. The body can be configured to be disposed at variable positions in the wellbore, such as variable depths within the wellbore. The body can be configured to be secured to a position in the wellbore by a landing mechanism, such as a nipple profile. The body can also include a substructure adapted for storing a non-conductive fluid in which the communications system can be disposed. The non-conductive fluid can prevent water or other downhole fluids from damaging the electrical circuits of the communications system. The closure mechanism of the ESSSV can be configured to be positioned in a passageway defined by the wellbore. The closure mechanism can prevent a flow of fluid to a portion of the passageway that is closer to a surface of the wellbore than the closure mechanism.

The communications system of the ESSSV can include one or more transceiving devices. The one or more transceiving devices can communicate signals via the cable. For example, a transceiving device can include a transmitter and a receiver communicatively coupled to the cable. The transceiving device can transmit signals to and receive signals from a rig located at the surface via the cable. Some aspects of the ESSSV can include the communications system receiving power via the cable. The one or more transceiving devices can also wirelessly communicate with other devices downhole. Wireless communication can include the communication of signals or other information between two or more points that are not physically connected. Wireless communication can also include the communication of signals or other information via a medium such as liquid or gas.

For example, a transceiving device can include a transmitter and a receiver configured to transmit signals to and receive signals from a tool in the wellbore and/or a tool in an adjacent wellbore within the signal range of the transceiving device. The communications system can also include a processing device. The processing device can process signals received by the one or more transceiving devices from other downhole devices. The processing device can process signals received via the cable, such as command or control signals transmitted by a rig at the surface of the wellbore.

Additional aspects can include one or more sensors disposed in the body. The one or more sensors can be disposed in a substructure of the body adapted to store a non-conductive fluid. The one or more sensors can be communicatively coupled to the processing device. The processing device can process and communicate data received from the sensors to a rig at the surface via the one or more transceiving devices coupled to the cable. A non-limiting of a sensor is a pressure sensor. One or more pressure sensors included in the ESSSV can be configured to detect the pressure in an annular space between the body of the ESSSV and the tubing string in which the ESSSV is disposed. One or more pressure sensors included in the ESSSV can be configured to detect the pressure on opposite sides of a closure mechanism, such as a flapper valve. Another non-limiting example of a sensor is a proximity sensor. Each of one or more proximity sensors included in the ESSSV can be configured to detect a proximity between the closure mechanism and the proximity sensor. The processing device can be configured to determine a position of the closure mechanism based on the proximity between the closure mechanism and a proximity sensor. Other examples of the one or more sensors can include (but are not limited to) flow measurement sensors configured to measure density of the production flow in the well system and temperature sensors configured to measure the temperature at one or more points in the wellbore.

Additional or alternative aspects can include the processing device configuring the ESSSV to perform one or more autonomous operations in response to measurements received via one or more sensors. For example, the processing device can configure the ESSSV to cease operation in response to one or more temperature sensors detecting an excessive threshold temperature or can configure the ESSSV to change the position of the closure mechanism in response to one or more pressure sensors detecting an excessive threshold pressure in the wellbore.

Additional or alternative aspects can include the processing device configuring the ESSSV to perform one or more safety and production operations. The one or more safety and production operations can be based on a production plan, on data obtained from one or more sensors disposed in the ESSSV, and/or data received via other sources such as satellite equipment. The processing device can thus provide autonomous control of intelligent tools in the well system and/or augment control provided by a rig at the surface.

A non-limiting example of safety and/or production operations can include operations performed in response to the loss of communication between the rig and the ESSSV. The processing device can determine that communication has ceased between the rig and the ESSSV based on, for example, the absence of control signals received via the cable from the rig over a predetermined period of time. The processing device can actuate the closure mechanism such that the ESSSV is set to a closed position in response to determining a loss of communication between the ESSSV and the rig. The processing device can additionally or alternatively close side door chokes in the well system response to determining the loss of communication between the ESSSV and the rig. Another non-limiting example of safety and/or production operations can include the processing device configuring the ESSSV to adjust the side door chokes by a percentage in response to data received via one or more sensors such that the side door chokes are partially open. Another non-limiting example of safety and/or production operations can include the processing device performing periodic diagnostic checks of the ESSSV and/or other intelligent tools in the well system. The processing device can generate one or more status messages describing the operation of the ESSSV and/or other intelligent tools and transmit the status messages to the rig via the cable.

Additional aspects of the ESSSV can include one or more hydraulic ports. A hydraulic port can be adapted to be coupled to a tool in the wellbore. The ESSSV can communicate fluid to the tool, such as hydraulic fluid communicated to the ESSSV via a control line from a rig at the surface of the wellbore. Including one or more hydraulic ports in the ESSSV can obviate the need to run a control line in the wellbore around the ESSSV to tools in the wellbore, thereby allowing for the use of wellbores with smaller diameters.

Additional aspects of the ESSSV can include one or more terminals. The one or more terminals can be adapted to be coupled to a tool in the wellbore. The one or more terminals can be configured to form an electrical connection between the electric subsurface safety value and the tool in the wellbore. Power can be provided to the tool via the electrical connection. For example, the ESSSV can receive power via a cable to a rig at the surface of the wellbore and provide the power to the tool via the electrical connection. The one or more terminals can also provide a data connection to a tool in the wellbore. Data can be provided to the tool via the data connection. For example, the ESSSV can receive control signals from a rig at the surface via a cable and provide the control signals to the tool via the data connection. The processing device can be configured to detect a fault or failure based on data received via the one or more terminals. The processing device can generate a disconnect command in response to detecting the fault or failure. The tool can be disconnected from the ESSSV based on the processing device generating the disconnect command. Including one or more terminals in the ESSSV can obviate the need to run a power and/or communication line in the wellbore around the ESSSV to tools in the wellbore, thereby allowing for the use of wellbores with smaller diameters.

Additional aspects can include the ESSSV being configured to be coupled to a docking station in the wellbore. The docking station can allow a target tool to be deployed into a wellbore without having a dedicated communication or control link between the target tool and the rig at the surface. The ESSSV can provide power to an intelligent tool operating in a well system via the docking station. The docking station can include an orientation mechanism and one or more terminals. The orientation mechanism can orient (or "dock") a downhole tool. Docking the tool can allow the tool to be coupled to the docking station via the one or more terminals. An example of an orientation mechanism can include a landing profile adapted to align the intelligent tool with the docking station. The landing profile can include a surface configured to interlock with the intelligent tool. The ESSSV can include at least one terminal configured for coupling the ESSSV to the docking station. The terminal can be configured to form an electrical connection for providing power and/or a data connection for providing data. The docking station can receive the power and/or data via the terminal of the ESSSV. The docking station can provide the power and/or data to a tool coupled to the docking station via the one or more terminals of the docking station. The docking station can provide the power and/or data to the tool via either direct contact or inductive contact.

Additional aspects of the docking station can include a communication subsystem. The docking station can communicate with an ESSSV and the intelligent tool via the communication subsystem. The communication subsystem can include transceiver circuitry (i.e. transmit circuitry and receive circuitry) for transmitting and receiving signals to and from the ESSSV and an intelligent tool docked in the docking station.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples. The following sections use directional descriptions such as "above," "below," "upper," "lower," "upward," "downward," "left," "right," "uphole," "downhole," etc. in relation to the illustrative examples as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative examples, the numerals and directional descriptions included in the following sections should not be used to limit the present invention.

FIG. 1 depicts a rig 104 at the surface of a well system 100. The rig 104 can communicate with a target tool 106 via an electric subsurface safety valve 102 with an integrated communications system.

The ESSSV 102 is a safety device installed in a wellbore to provide emergency closure of a well system 100. The ESSSV 102 can be actuated to prevent the flow of production fluid through a casing string.

A target tool 106 may be deployed in the well system using any suitable mechanism. Non-limiting examples of such a deployment mechanism can include a wireline or slickline. Non-limiting examples of a target tool 106 can include a sensor monitoring one or more conditions in the wellbore such as temperature and pressure, a potentiometer configured to monitor the state of another tool in the wellbore, a shifting tool, a packer setting tool, and the like. The target tool 106 may have a communications system with a range that is less than the depth at which the target tool is deployed.

Figure 2:
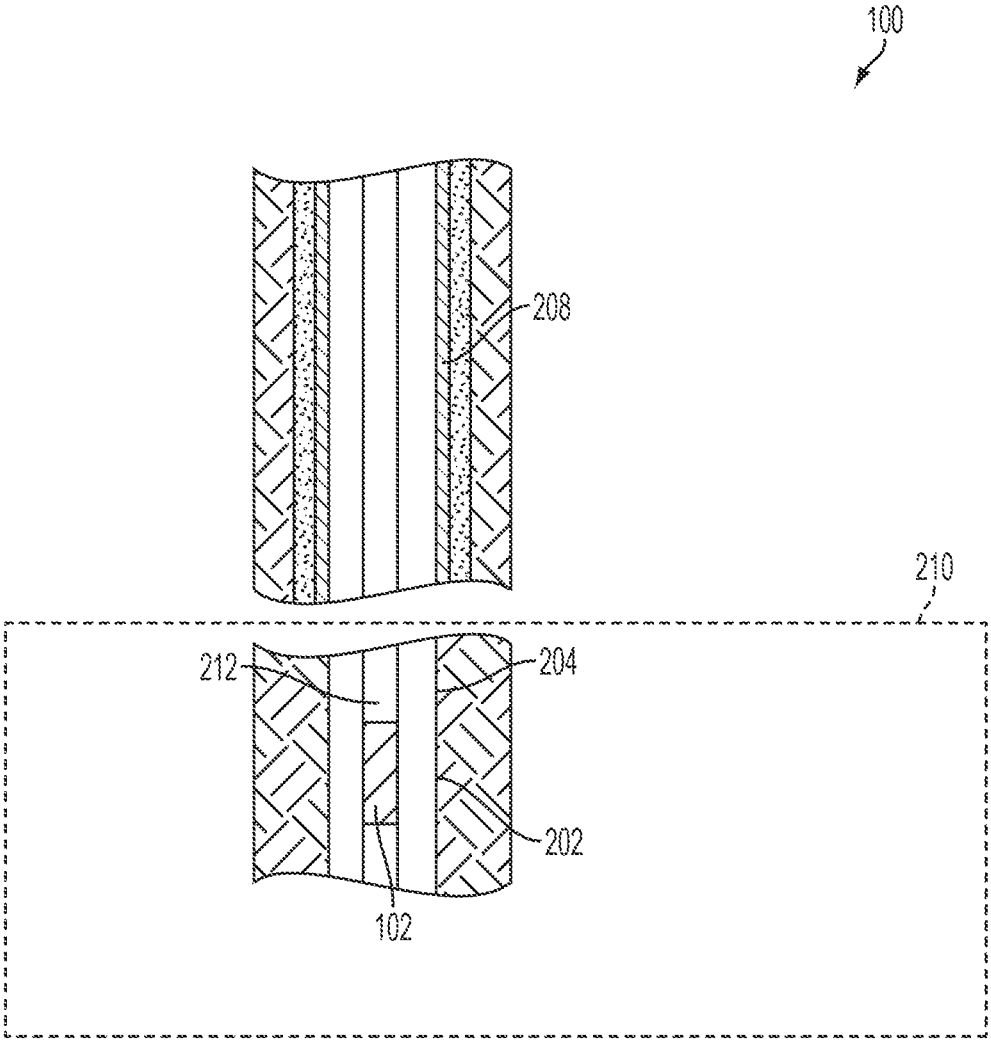
FIG. 2 is a schematic illustration of a well system having an electric subsurface safety valve according to one aspect of the present invention.

FIG. 2 schematically depicts the well system 100 with the ESSSV 102 according to certain aspects. The well system 100 includes a wellbore 202 extending through various earth strata. The wellbore 202 has a substantially vertical section 204. The substantially vertical section 204 may include a casing string 208 cemented at an upper portion of the substantially vertical section 204. The substantially vertical section 204 extends through a hydrocarbon-bearing subterranean formation 210.

A tubing string 212 extends from the surface within wellbore 202. The tubing string 212 can define a passageway providing a conduit for production of formation fluids to the surface.

The ESSSV 102 is positioned within a passageway defined by the casing string 208 and/or the wellbore 202. The ESSSV 102 is depicted as a functional block in FIG. 2. Pressure from the subterranean formation 210 can cause fluids to flow from the subterranean formation 210 to the surface. The ESSSV 102 can include equipment capable of restricting or preventing the production of formation fluids.

Although FIG. 2 depicts the ESSSV 102 positioned in the substantially vertical section 204, an ESSSV 102 can be located, additionally or alternatively, in a deviated section, such as a substantially horizontal section. In some aspects, an ESSSV 102 can be disposed in wellbores having both a substantially vertical section and a substantially horizontal section. An ESSSV 102 can be disposed in open hole environments, such as is depicted in FIG. 2, or in cased wells.

Figure 3:
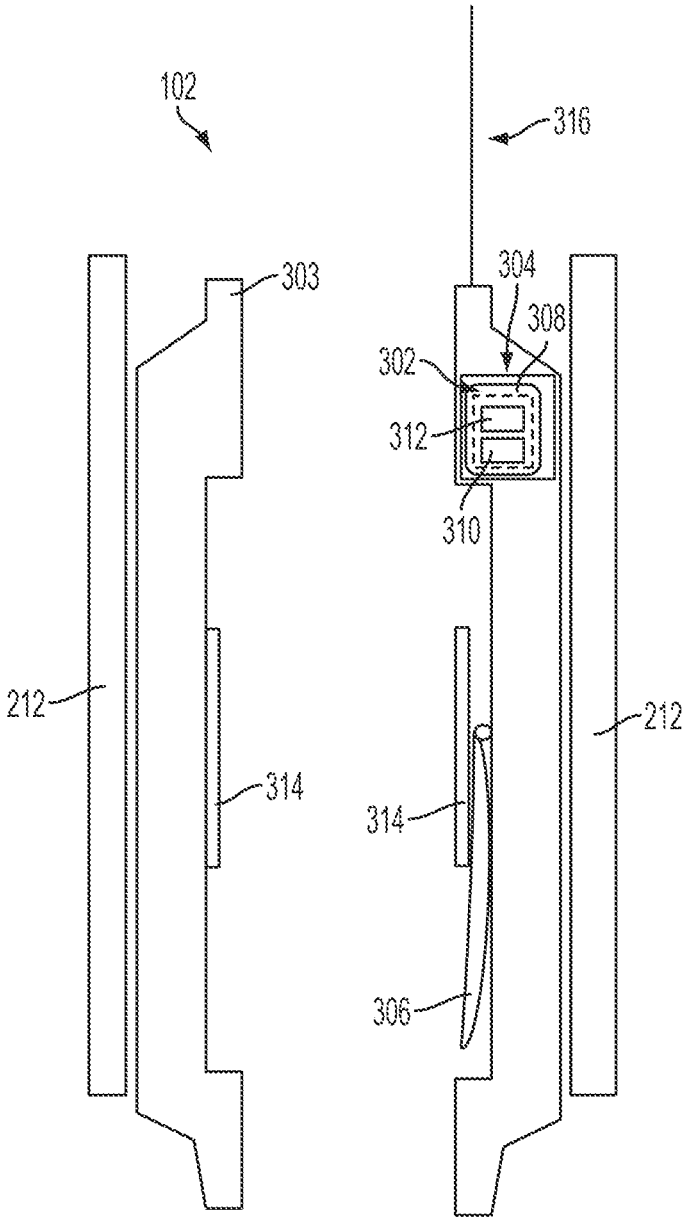
FIG. 3 is a cross-sectional side view of the electric subsurface safety valve having an integrated communications system according to one aspect of the present invention.

FIG. 3 depicts a cross-sectional side view of an ESSSV 102 including an integrated communications system 302 according to one aspect.

The ESSSV 102 can include a housing 303, the communications system 302, a substructure 304, a closure mechanism 306, and a flow tube 314.

The ESSSV 102 can be inserted into a passageway defined by the wellbore 202 and/or the casing string 208 via a cable 316 coupled to the ESSSV 102. The ESSSV 102 can receive power from and communicate with a rig 104, such as an oil rig, positioned at the surface of the wellbore. The ESSSV 102 can receive power from and communicate with the rig 104 via the cable 316.

The housing 303 can be manufactured from any suitable material. Examples of suitable material can include (but are not limited to) steel or other metals. The housing 303 can be a unitary structure or a group of structures coupled to one another. For example, a housing 303 can include a group of structures coupled to one another to provide one or more compartments in which a communications system 302 or other systems or devices can be disposed and/or isolated from one another.

The closure mechanism 306 can be any mechanism for restricting or preventing the flow of fluid or communication of pressure from the fluid-producing formation fluid to the surface of the wellbore 202, such as a valve. The closure mechanism 306 is depicted in FIG. 3 as a flapper valve actuated via the flow tube 314. The flapper valve can include a spring-loaded plate allowing fluids to be pumped in the downhole direction from the surface toward the fluid-producing formation. The flapper valve can close when the flow of fluid is directed toward the surface. Other examples of a closure mechanism 306 can include (but are not limited to) a poppet valve or a ball valve. A ball valve can include a spherical disc having a port through the middle such that fluids can flow through the ball valve when the port is aligned with both ends of the ball valve. The ball valve can be closed to block the flow of fluids by orienting the spherical disc such that the port is perpendicular to the ends of the ball valve. A poppet valve can include a hole and a tapered plug portion, such as a disk shape on the end of a shaft. The shaft guides the plug portion by sliding through a valve guide. A pressure differential can seal the poppet valve.

Although FIG. 3 depicts a closure mechanism 306 actuated via a flow tube 314, the closure mechanism 306 can be actuated using any suitable device, such as (but not limited to), a linear actuator, a long stroke solenoid, or a linear induction motor.

The communications system 302 can be disposed in a substructure 304. The substructure 304 can include any suitable chamber. The substructure 304 can store a non-conducting fluid 308, such as a silicone oil fluid or another silicone fluid or dielectric fluid. The non-conducting fluid 308 can expand or contract in response to the pressure at the depth of the ESSSV 102. The substructure 304 can allow the communications system 302 to be deployed in a well system 100 without contamination from water or other downhole fluids. Although FIG. 3 depicts the substructure 304 as a separate structure disposed in the housing 303, other implementations are possible. For example, the housing 303 can be adapted to provide a substructure 304 integral with the housing 303 in which the non-conducting fluid 308 can be stored. The communications system 302 can include a processing device 310 and a communications module 312 disposed in the substructure 304.

The processing device 310 can include any suitable control circuitry for controlling one or more functions of the ESSSV 102 based on commands from a control system at the surface. Examples of the processing device 310 include a microprocessor, a peripheral interface controller ("PIC"), an application-specific integrated circuit ("ASIC"), a field-programmable gate array ("FPGA"), or other suitable processing device. The processing device 310 may include one processor or any number of processors.

The communications module 312 can include one or more devices for communicating with a target tool 106 in the well system 100. The communications module 312 can include receive circuitry and transmit circuitry for wirelessly communicating with a target tool 106. The communications module 312 can include receive circuitry and transmit circuitry for receiving and transmitting signals to and from the control system at the surface.

The ESSSV 102 can control or communicate with the target tool 106 by deploying the ESSSV 102 to a depth within the range of a communications system of the target tool 106. Signals from the rig 104 at the surface can be communicated via the cable 316 to the ESSSV 102. The communications system 302 of the ESSSV 102 can wirelessly communicate with the target tool 106. The signals can be communicated wirelessly via electromagnetic or acoustic communication techniques. Signals from the intelligent tool can be communicated to the ESSSV 102. The communications system 302 of the ESSSV 102 can communicate signals from the intelligent tool to the surface via the cable 316.

For example, the target tool 106 can be a running tool configured to deploy equipment in the well system 100. The running tool can capture data describing whether the equipment has been properly secured in the well system 100. The ESSSV 102 having the communications system 302 can communicate with the running tool to receive the data. The ESSSV 102 can communicate the data to the surface via the cable 316, obviating the need to return the running tool to the surface.

Additional aspects of the ESSSV 102 can include the communications system 302 communicating with devices in other well systems. For example, the ESSSV 102 can communicate with an intelligent tool in a well system that is adjacent to the well system 100 and within the range of the communications system 302.

Additional aspects of the ESSSV 102 can include one or more sensors disposed in the ESSSV 102, as depicted in FIGS. 4-10.

Figure 4:
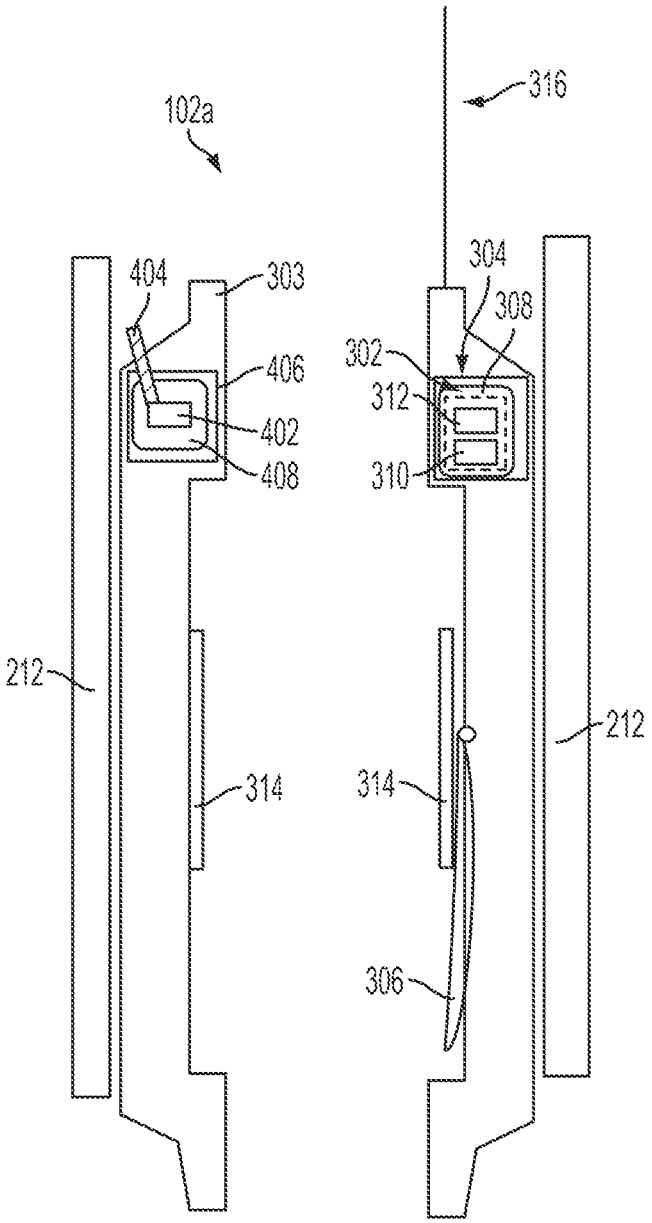
FIG. 4 is a cross-sectional side view of the electric subsurface safety valve having an integrated communications system and at least one sensor for measuring annular fluid properties according to one aspect of the present invention.

FIG. 4 is a cross-sectional side view of an ESSSV 102*a* having an integrated communications system 302 and a sensor 402 for measuring annular fluid properties. The sensor 402 can be disposed in a substructure 406 of the housing 303. The substructure 406 can be adapted to store a non-conducting fluid 408. The sensor 402 can be coupled to a probe 404. The probe 404 can monitor one or more properties of fluid in an annulus between the outer diameter of the ESSSV 102*a* and the inner diameter of the tubing string 212. Non-limiting examples of such properties can include pressure, temperature, rate of fluid flow, etc. The sensor 402 can communicate measurements of the properties to the processing device 310.

Figure 5:
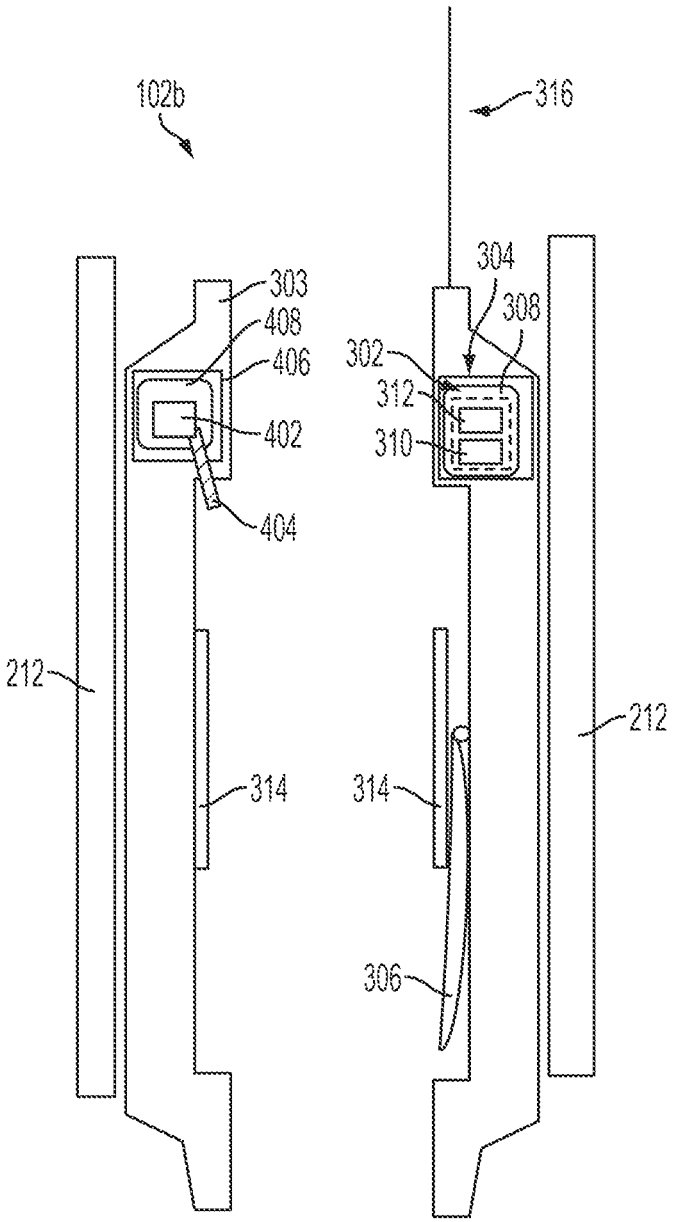
FIG. 5 is a cross-sectional side view of the electric subsurface safety valve having an integrated communications system and at least one sensor for measuring properties of fluid within the electric subsurface safety valve according to one aspect of the present invention.

FIG. 5 is a cross-sectional side view of the ESSSV 102*b* having an integrated communications system 302 and at least one sensor 402 for measuring properties of fluid within the ESSSV 102*b*. The probe 404 of the sensor 402 can measure the properties of fluid within the ESSSV 102*b*.

Figure 6:
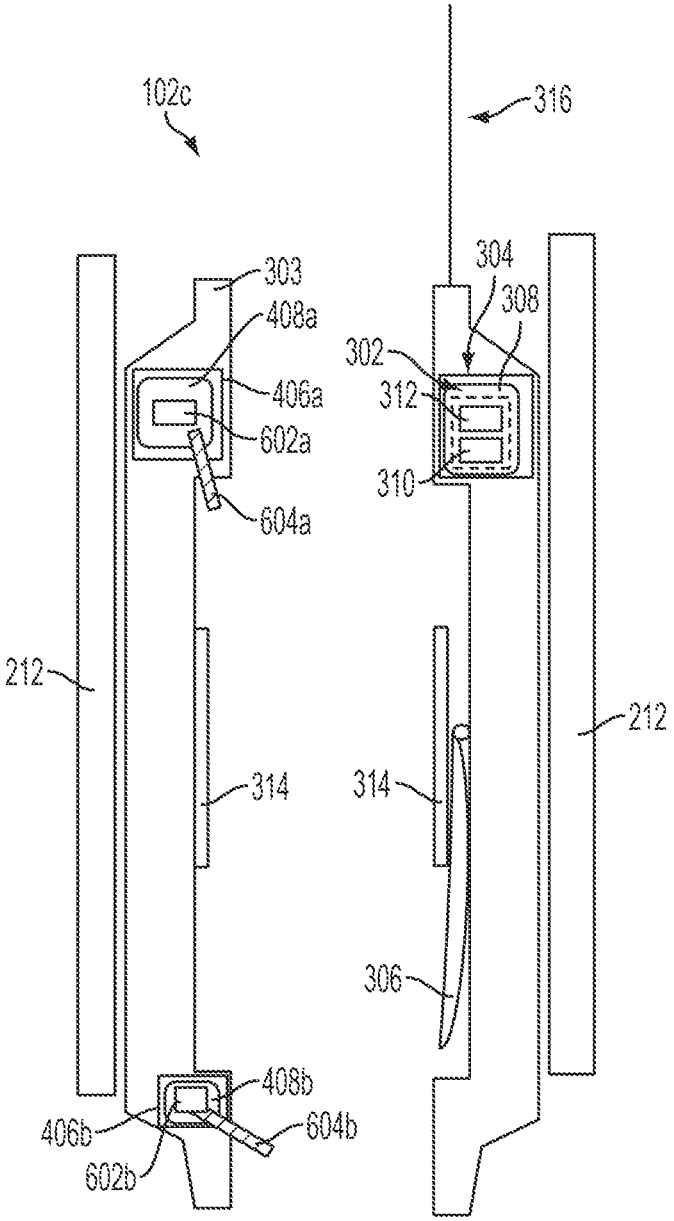
FIG. 6 is a cross-sectional side view of the electric subsurface safety valve having an integrated communications system and sensors for measuring properties of fluid on opposite sides of a closure mechanism of the electric subsurface safety valve according to one aspect of the present invention.

FIG. 6 is a cross-sectional side view of an ESSSV 102*c* having an integrated communications system 302 and sensors 602*a*, 602*b*. The sensors 602*a*, 602*b* can be respectively disposed in substructures 406*a*, 406*b* of the housing 303. The substructures 406*a*, 406*b* can be adapted to store non-conducting fluids 408*a*, 408*b*. The sensors 602*a*, 602*b* can be respectively coupled to the probes 604*a*, 604*b*. The probes 604*a*, 604*b* can monitor properties of fluid on opposite sides of the closure mechanism 306. For example, the sensors 602*a*, 602 can measure the pressure of fluid on opposite sides of a closure mechanism 306 that is a flapper valve. The sensors 602*a*, 602*b* can communicate measurements to the processing device 310.

Figure 7:
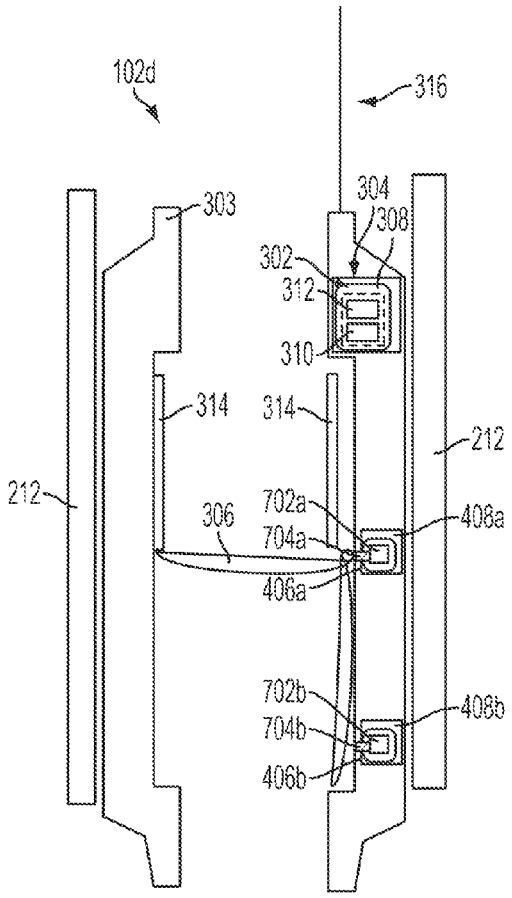
FIG. 7 is a cross-sectional side view of the electric subsurface safety valve having an integrated communications system and sensors for determining a closed position of the closure mechanism according to one aspect of the present invention.
Figure 8:
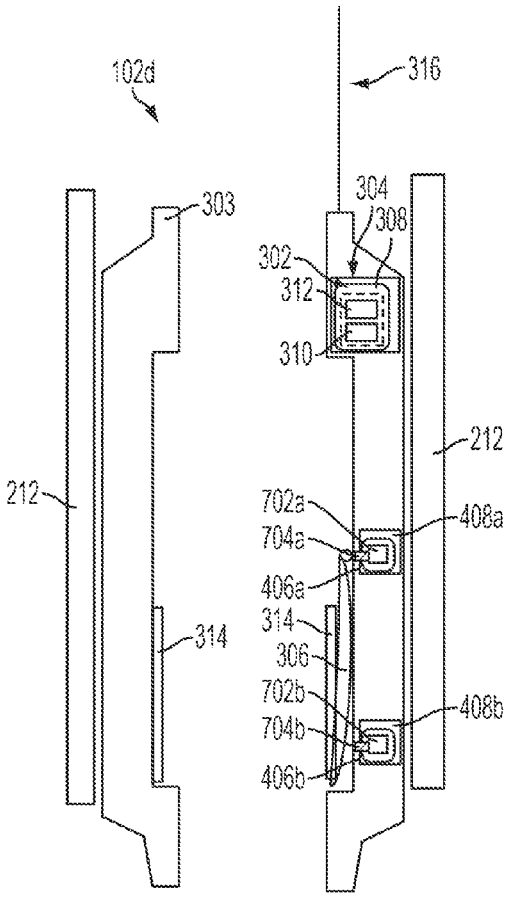
FIG. 8 is a cross-sectional side view of the electric subsurface safety valve having an integrated communications system and sensors for determining an open position of the closure mechanism according to one aspect of the present invention.

Additional aspects of the ESSSV 102 can include proximity sensors configured to detect the position of the closure mechanism 306. FIGS. 7 and 8 are cross-sectional side views of an ESSSV 102*d* having proximity sensors 702*a*, 702*b* for determining the position of the closure mechanism 306. The proximity sensors 702*a*, 702*b* can each monitor a proximity between the closure mechanism 306 and the respective proximity sensor. The proximity sensors 702*a*, 702*b* can communicate data describing the proximity between the closure mechanism 306 and the respective proximity sensors to the processing device 310. The processing device 310 can determine whether the closure mechanism is at a closed position, as depicted in FIG. 7, or an open position, as depicted in FIG. 8, based on the respective proximities between the closure mechanism 306 or some part of the closure mechanism 306 and each of the sensors 702*a*, 702*b*. For example, the processing device 310 can determine that the closure mechanism 306 is in a closed position in FIG. 7 based on the closure mechanism 306 or some part of the closure mechanism 306 being in proximity to the sensor 702*a* and not being in proximity to the sensor 702*b*. The processing device 310 can determine that the closure mechanism 306 is in an open position based on the closure mechanism 306 or some part of the closure mechanism 306 being in proximity to the sensor 702*a* and the sensor 702*b*.

Figure 9:
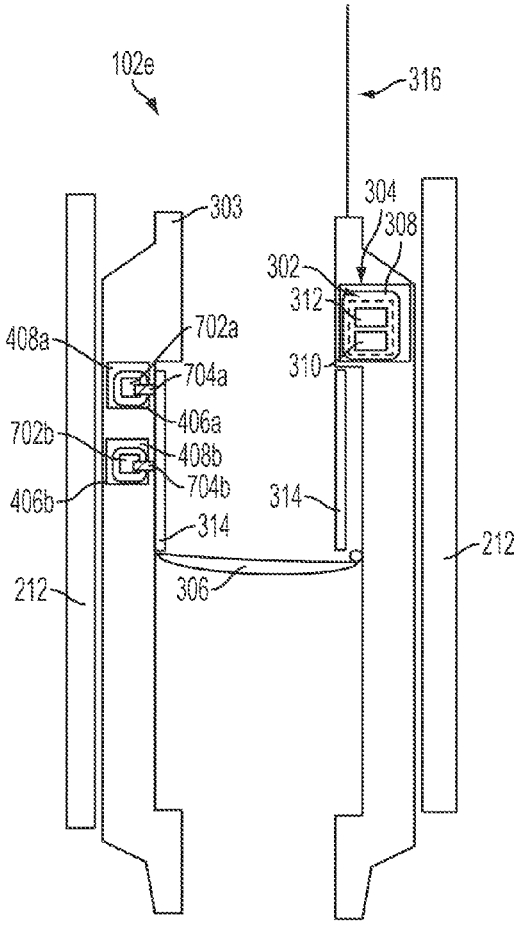
FIG. 9 is a cross-sectional side view of the electric subsurface safety valve having an integrated communications system and sensors for determining the position of a flow tube configured to actuate the closure mechanism in a closed position according to one aspect of the present invention.
Figure 10:
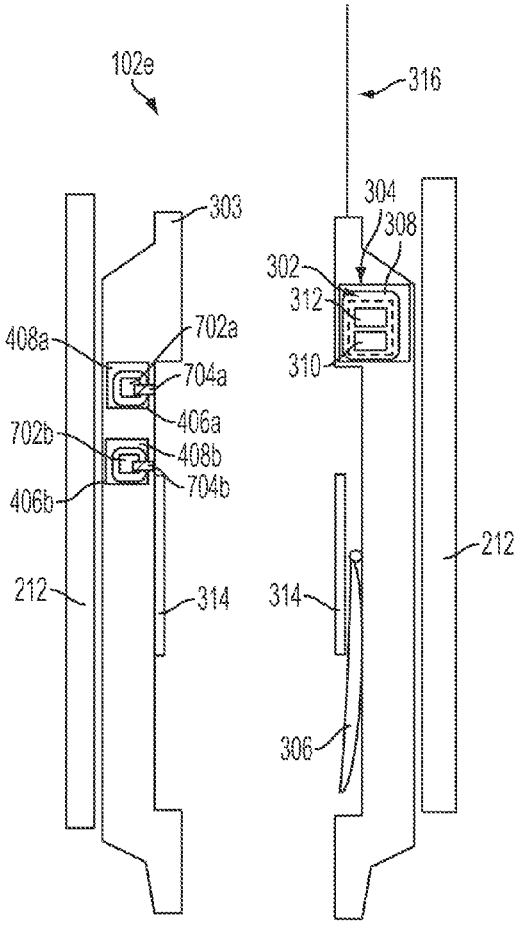
FIG. 10 is a cross-sectional side view of the electric subsurface safety valve having an integrated communications system and sensors for determining the position of a flow tube configured to actuate the closure mechanism in an open position according to one aspect of the present invention.

FIGS. 9 and 10 are cross-sectional side views of an ESSSV 102*e* having proximity sensors 702*a*, 702*b* for determining the position of the flow tube 314. The proximity sensors 702*a*, 702*b* can each monitor a proximity between the flow tube 314 and the respective proximity sensor. The proximity sensors 702*a*, 702*b* can communicate data describing the proximity between the flow tube 314 and the respective proximity sensors to the processing device 310. The processing device 310 can determine whether the closure mechanism is at an open position or a closed position based on the respective proximities between the flow tube 314 and each of the sensors 702*a*, 702*b*. For example, the processing device 310 can determine that the closure mechanism 306 is in a closed position, as depicted in FIG. 9, based on the flow tube 314 being in proximity to the sensors 702*a*, 702*b*. The processing device 310 can determine that the closure mechanism 306 is in an open position, as depicted in FIG. 10 based on the flow tube 314 being in proximity to the sensor 702*b*.

Additional or alternative aspects can include the processing device 310 configuring the ESSSV 102 to perform one or more autonomous operations in response to measurements received via one or more sensors. In one aspect, a sensor can be disposed in the substructure 304 to monitor the temperature of the non-conducting fluid 308. Such a sensor can provide measurements of the temperature of the non-conducting fluid 308 or other components of the ESSSV 102 to the processing device 310. The processing device 310 can determine that a temperature of the non-conducting fluid 308 exceeds a threshold temperature. In response to determining that the temperature of the non-conducting fluid 308 exceeds a threshold temperature, the processing device 310 can configure the ESSSV 102 to cease operation. In another aspect, a pressure sensor can provide measurements of wellbore pressure to the processing device 310. The processing device 310 can configure the ESSSV 102 to autonomously change the position of the closure mechanism 306 in response to the measurements of wellbore pressure exceeding a threshold pressure.

Additional or alternative aspects can include the processing device 310 configuring the ESSSV 102 to perform one or more safety and production operations. The one or more safety and production operations can be based on a production plan, on data obtained from one or more sensors disposed in the ESSSV 102, and/or data received via other sources such as satellite equipment. The processing device 310 can thus provide autonomous control of intelligent tools in the well system 100 and/or augment control provided by a rig at the surface.

A non-limiting example of safety and/or production operations can include operations performed in response to the loss of communication between the rig 104 and the ESSSV 102. The processing device 310 can determine that a loss of communication between the rig 104 and the ESSSV 102 based on, for example, the absence of control signals received via the cable 316 from the rig 104 over a predetermined period of time. The processing device 310 can actuate the closure mechanism 306 such that the ESSSV 102 is set to a closed position in response to determining the loss of communication between the ESSSV 102 and the rig 104. The processing device 310 can additionally or alternatively close side door chokes in the well system 100 response to determining the loss of communication between the ESSSV 102 and the rig 104. Another non-limiting example of safety and/or production operations can include the processing device 310 configuring the ESSSV 102 to adjust the side door chokes by a percentage in response to data received via one or more sensors such that the side door chokes are partially open. Another non-limiting example of safety and/or production operations can include the processing device 310 performing periodic diagnostic checks of the ESSSV 102 and/or other intelligent tools in the well system 100. The processing device 310 can generate one or more status messages describing the operation of the ESSSV 102 and/or other intelligent tools and transmit the status messages to the rig 104 via the cable 316.

Figure 11:
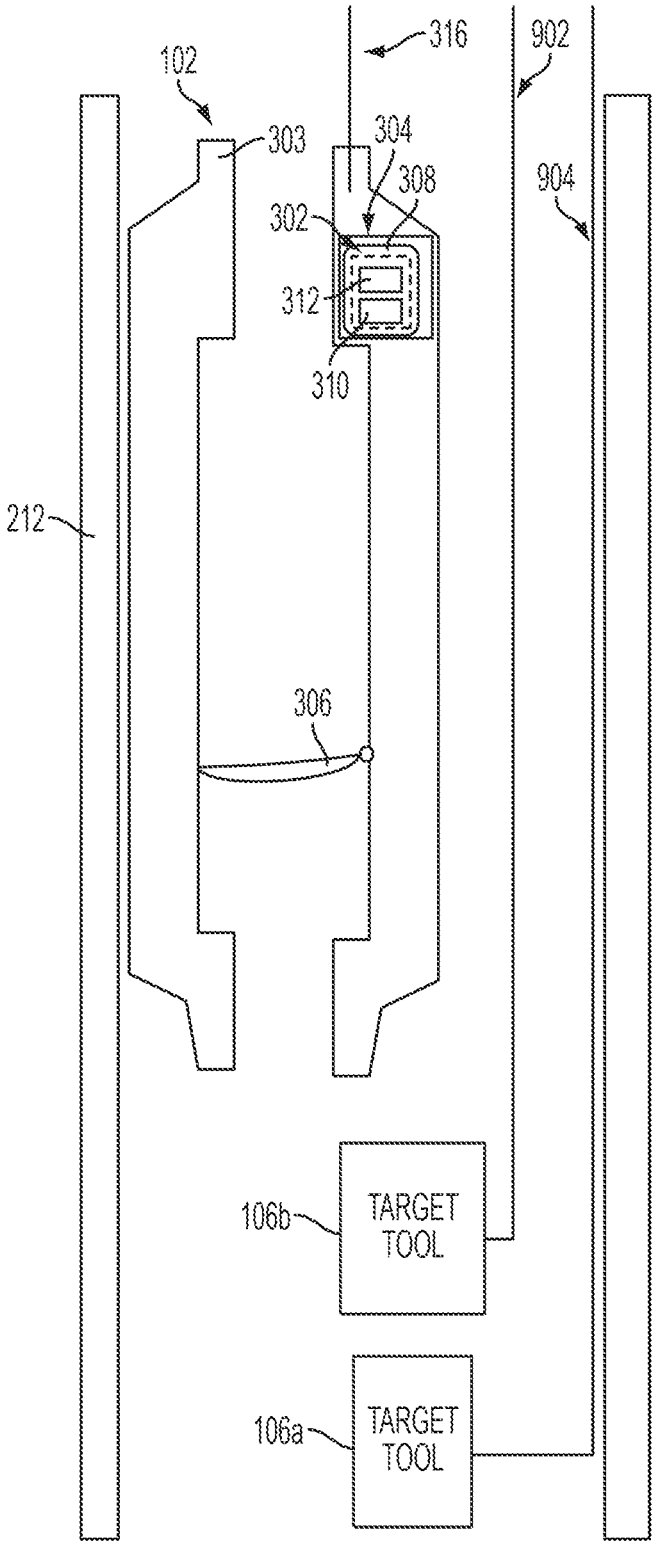
FIG. 11 is a cross-sectional side view of a system including control lines deployed adjacent to an electric subsurface safety valve to configure tools in a wellbore according to one aspect of the present invention.

Additional or alternative aspects can include the ESSSV 102 providing a hub between one or more target tools and a rig 104 at a surface of the well system 100. Prior solutions, such as those depicted in FIG. 11, can require deploying control lines adjacent to the outer diameter of an ESSSV 102 to configure or communicate with target tools 106*a*, 106*b* in a well system 100. Deploying control lines adjacent to the outer diameter of an ESSSV 102 can cause the wellbore 202 and/or the casing string 208 to have a wider diameter than desirable. Using the ESSSV 102 as a hub between target tools and the rig 104 can obviate the need to deploy control lines adjacent to an ESSSV 102 to configure or communicate with target tools 106*a*, 106*b* in a well system 100, as depicted in FIG. 11.

Figure 12:
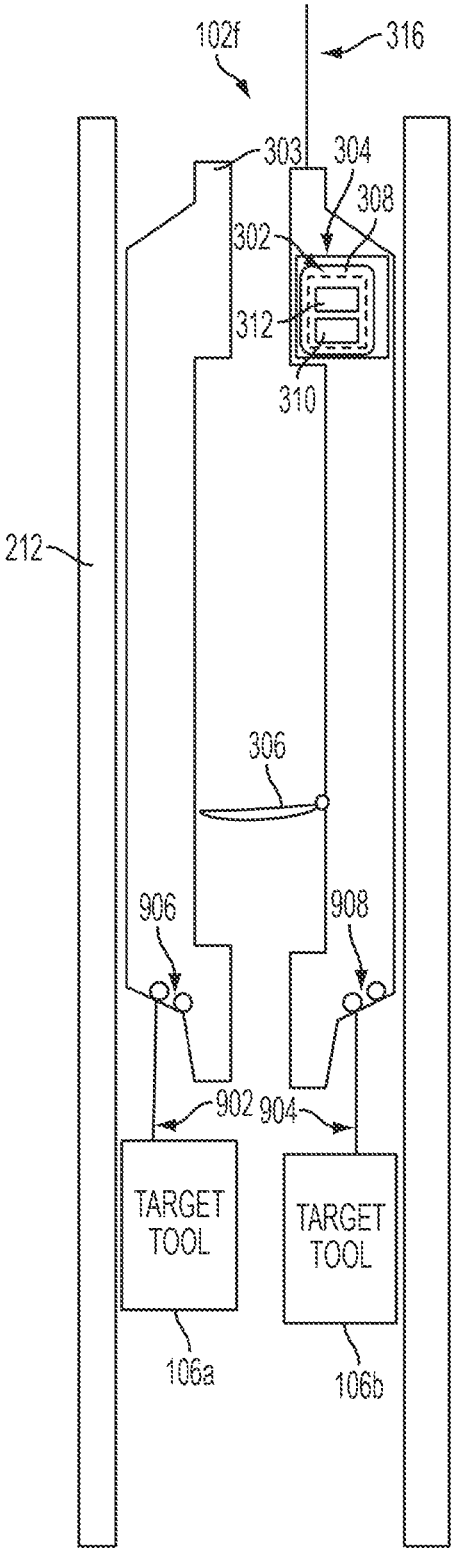
FIG. 12 is a cross-sectional side view of the electric subsurface safety valve having an integrated communications system and adapted to provide a hub for configuring tools in a wellbore according to one aspect of the present invention.

FIG. 12 is a cross-sectional side view of an ESSSV 102*f* being adapted to provide a hub for configuring target tools 106*a*, 106*b* in a wellbore. The ESSSV 102*f* can include one or more hydraulic ports 906. A hydraulic port 906 can be adapted to be coupled to a target tool 106*a* in the wellbore via a hydraulic line 902. The ESSSV 102*f* can communicate fluid to the tool via the hydraulic line 902. The ESSSV 102*f* can receive hydraulic fluid via a control line from the rig 104 at the surface of the well system 100.

The ESSSV 102*f* can also include one or more terminals 908. The one or more terminals 908 can be adapted to be coupled to a tool in the wellbore, such as a target tool 106*b*. A non-limiting example of a terminal 908 is a multi-pin connector. The one or more terminals 908 can be configured to form an electrical connection between the electric subsurface safety valve and the target tool 106*b* via a cable 904. Power can be provided to the target tool 106 via the electrical connection. For example, the ESSSV 102*f* can receive power via the cable 316 to the rig 104. The ESSSV 102*f* can provide the power to the target tool 106*b* via the cable 904. The terminals 908 can also provide a data connection to the target tool 106*b*. Data can be provided to the target tool 106*b* via the data connection. For example, the ESSSV 102*f* can receive control signals from the rig 104 via the cable 316 and provide the control signals to the target tool 106*b* via the data connection.

The processing device 310 can be configured to detect a fault or failure based on data received via the one or more terminals 908. The processing device 310 can generate a disconnect command in response to detecting the fault or failure. The target tool 106*b* can be disconnected from the ESSSV 102*f* based on the processing device 310 generating the disconnect command.

Although FIG. 12 depicts an ESSSV 102*f* coupled to the target tools 106*a*, 106*b* via the hydraulic line 902 and the cable 904, respectively, other implementations are possible. For example, a target tool can be coupled to a hydraulic port of terminal via a port or terminal integral with the target tool.

Although FIG. 12 depicts an ESSSV 102*f* having two hydraulic ports 906 and two terminals 908, any number of hydraulic ports or terminals can be used. For example, an ESSSV can be implemented with only hydraulic ports or only terminals.

Figure 13:
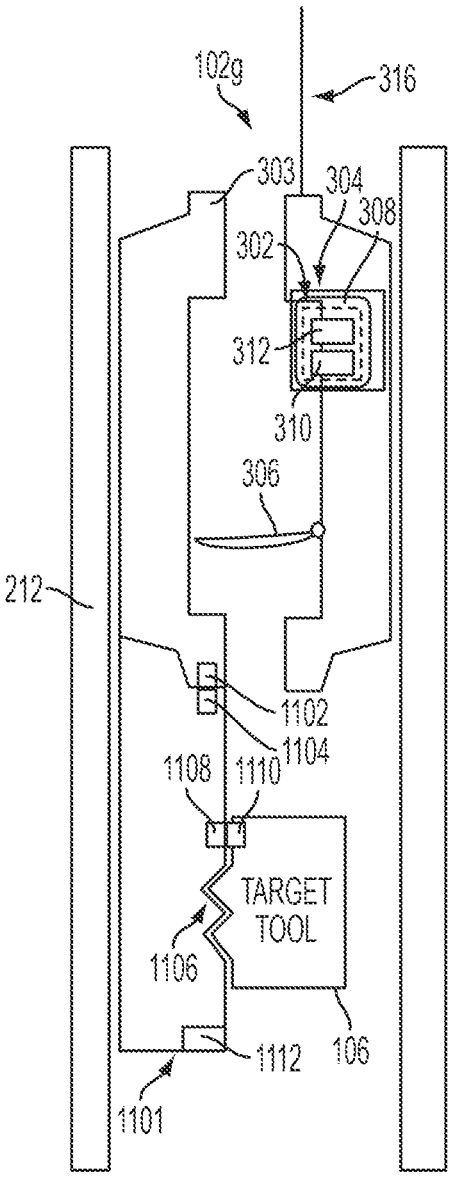
FIG. 13 is a cross-sectional side view of an electric subsurface safety valve coupled to a docking station configured to be coupled to tools in a wellbore via a direct connection according to one aspect of the present invention.
Figure 14:
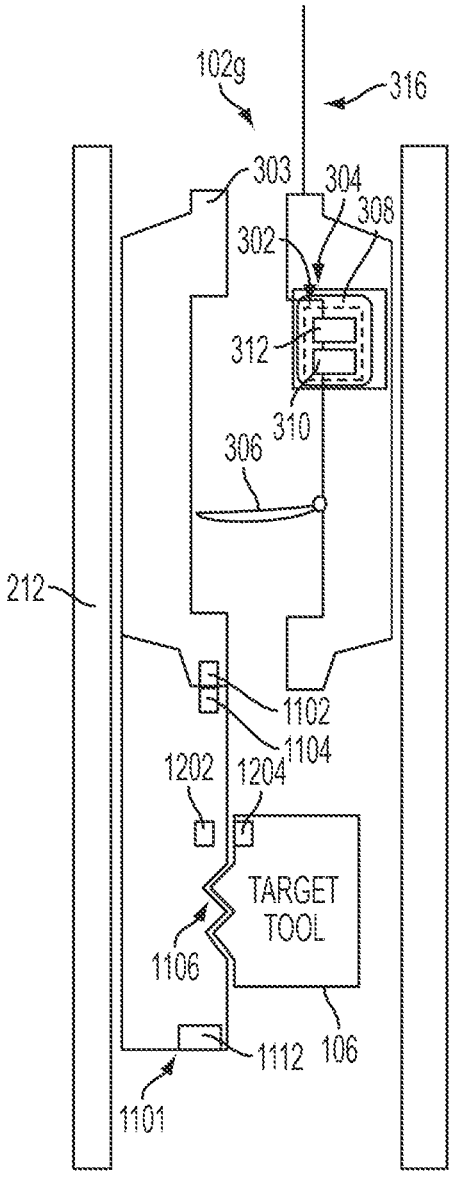
FIG. 14 is a cross-sectional side view of an electric subsurface safety valve coupled to a docking station configured to be coupled to tools in a wellbore via an inductive connection according to one aspect of the present invention.

Additional or alternative aspects can include a docking station coupled to an ESSSV having an integrated communications system. FIGS. 13 and 14 depict cross-sectional side views of an ESSSV 102*g* coupled to a docking station 1101. The docking station 1101 can be coupled to tools in a wellbore, such as a target tool 106. FIGS. 13 and 14 depict one half of a section of the docking station 1101 and the target tool 106. The ESSSV 102*g* can provide power to the target tool 106 via the docking station 1101.

As depicted in FIG. 13, the docking station 1101 can include terminals 1104, 1108, an orientation mechanism 1106, and a communication subsystem 1112.

The docking station 1101 can be coupled to the ESSSV 102*g* via a connection between a terminal 1102 of the ESSSV 102*g* and the terminal 1104 of the docking station 1101. The ESSSV 102*g* can communicate with the docking station 1101 via the connection between the terminals 1102, 1104. The ESSSV 102*g* can also provide power to the docking station 1101 via the connection between the terminals 1102, 1104. The docking station 1101 can allow a target tool 106 to be deployed into a well system 100 without having a dedicated communication or control link between the target tool 106 and the rig 104 at the surface.

The orientation mechanism 1106 can orient (or "dock") the target tool 106. Docking the target tool 106 can allow the target tool 106 to be coupled to the docking station 1101. An example of an orientation mechanism can include a landing profile adapted to align the intelligent tool with the docking station 1101. The landing profile can include a surface configured to interlock with the intelligent tool.

The docking station 1101 can provide power and/or data received from the ESSSV 102*g* to the target tool 106. As depicted in FIG. 13, the docking station 1101 can include a terminal 1108 configured to provide power and/or data via a direct contact with a terminal 1110 of the target tool 106. As depicted in FIG. 14, the docking station 1101 can include a terminal 1202 configured to provide power and/or data via inductive contact with a terminal 1202 of the target tool 106.

The docking station 1101 can communicate with the ESSSV 102*g* and the target tool 106 via the communication subsystem 1112. The communication subsystem 1112 can include transmit circuitry and receive circuitry for transmitting and receiving signals to and from the ESSSV 102*g* and the target tool 106. The target tool 106 can be actuated or otherwise configured in response to the signals communicated via the ESSSV 102*g*.

Although FIGS. 13-14 depict the docking station 1101 coupled to the ESSSV 102*g* via a direct connection between the terminals 1102, 1104, other implementations are possible. For example, the docking station 1101 can be coupled to the ESSSV 102*g* via an inductive connection between the terminals 1102, 1104 or via a cable connection between the terminals 1102, 1104.

In additional aspects, a docking station 1101 can be connected to one or more additional docking stations via a daisy-chain configuration. A target tool 106 can receive power and/or communicate signals from the ESSSV 102*g* via the docking station 1101 and the additional docking station coupled to the docking station 1101.

In some aspects, a target tool 106 can operate at or near the docking station 1101. In other aspects, a first tool can be docked in the docking station 1101 and a second tool can be deployed further into the wellbore. The second tool can be tethered to the first tool that is docked in the docking station 1101.

In additional or alternative aspects, the target tool 106 can be a tool deployed into the wellbore to shift a sleeve in the well system 100. After an attempt to shift the sleeve in the well system 100, the target tool 106 can be docked in the docking station 1101. Information can be communicated between the target tool 106 and the rig 104 via the docking station 1101 and the communication system of the ESSSV 102. The information can include, for example, accelerator information or data from a potentiometer. A control system at the rig 104 can analyze the information to determine that the sleeve was not shifted to a specified position. The control system at the rig 104 can communicate a control signal to the target tool 106 to perform a second attempt shift the sleeve. The target tool 106 can thus be configured to perform multiple shifting operations without retrieving the target tool 106 from the wellbore.

In additional or alternative aspects, multiple target tools can be deployed in the wellbore via a wireline unit. A wireline unit can be a mechanism including an electrical cable to lower tools into a wellbore. A respective target tool can be docked after performing a downhole operation. Information can exchanged between the rig 104 at the surface and the wireline tool. Control signals can be transmitted from the rig 104 to reconfigure the tool to perform a subsequent operation.

A non-limiting example of a target tool 106 deployed via a wireline unit is a logging tool. The logging tool can be docked in the docking station 1101 after a logging operation is performed. The logging information can be transmitted to the rig 104 via the docking station 11011. A control system at the rig 104 can be used to evaluate the logging information to determine whether to perform an additional logging operation.

Another non-limiting example of a target tool 106 deployed via a wireline unit is a shifting tool. The shifting tool can be docked in the docking station 1101 after a shifting operation is performed. The shifting information can be transmitted to the rig 104 via the docking station 11011. A control system at the rig 104 can be used to evaluate the shifting information to determine whether to perform an additional shifting operation.

Another non-limiting example of a target tool 106 deployed via a wireline unit is a camera or other recording device deployed in the wellbore to monitor downhole operations performed by other tools. The camera or other recording device can be docked in the docking station 1101 after a recording operation monitoring a downhole operation by one or more downhole tools is performed. The recorded information, such as video content, can be transmitted to the rig 104 via the docking station 11011. A control system at the rig 104 can be used to examine the recorded information to determine whether the downhole operation is successful prior to retrieving the one or more downhole tools from the wellbore.

In some aspects, the docking station 1101 can be an integral with the ESSSV 102. In other aspects, the docking station 1101 can be positioned further into the wellbore 202 than the ESSSV 102. The docking station 1101 can be connected to the ESSSV 102 by one or more tubing sections and one or more cables.

The foregoing description of the examples, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. An electric subsurface safety valve configured for being disposed in a wellbore through a fluid-producing formation, the electric subsurface safety valve comprising:

a body adapted to be coupled to a cable;

a communications system disposed in the body, the communications system comprising:

one or more transceiving devices configured to communicate signals via the cable and to wirelessly communicate signals;

a processing device configured to process the signals received by the one or more transceiving devices for communication via the cable;

a closure mechanism configured to be positioned in a passageway defined by the wellbore, wherein the closure mechanism is configured to prevent a flow of fluid to a portion of the passageway that is closer to a surface of the wellbore than the closure mechanism; and at least one terminal adapted to be coupled to a tool in the wellbore, the at least one terminal configured to form an electrical connection for providing power received via the cable to the additional tool.

2. The electric subsurface safety valve of claim 1, wherein the body further comprises a substructure adapted for storing a non-conductive fluid and wherein the communications system is disposed within the substructure.

3. The electric subsurface safety valve of claim 1, wherein the body is configured to be deployed in the wellbore via a tubing section of the tubing string at a variable position in the wellbore.

4. The electric subsurface safety valve of claim 1, wherein the communications system is configured to receive power via the cable.

5. The electric subsurface safety valve of claim 1, further comprising at least one sensor disposed in the body and configured to communicate signals via the communications system.

6. The electric subsurface safety valve of claim 5, wherein the at least one sensor comprises at least one of a pressure sensor, a flow measurement sensor, a proximity sensor, or a temperature sensor.

7. The electric subsurface safety valve of claim 1, wherein the electric subsurface safety valve comprises the at least one terminal and wherein the at least one terminal is further configured to form a data connection to the additional tool.

8. The electric subsurface safety valve of claim 1, wherein the processing device is further configured to detect a fault or failure based on data received via the at least one terminal.

9. The electric subsurface safety valve of claim 1, wherein the processing device is further configured to generate a disconnect command in response to detecting a fault or failure and wherein the at least one terminal is configured to disconnect the electrical connection based on the processing device generating the disconnect command.

10. The electric subsurface safety valve of claim 1, wherein the body is further configured to be coupled to a docking station, wherein the docking station is coupled to the tool via the at least one terminal.

11. An electric subsurface safety valve configured for being disposed in a wellbore through a fluid-producing formation, the electric subsurface safety valve comprising:

a body adapted to be coupled to a cable and to be disposed within the wellbore at a variable position in the wellbore;

a communications system embedded in the body, the communications system comprising:

one or more transceiving devices configured to communicate signals via the cable and to communicate signals wirelessly;

a processing device configured to process signals received by the one or more transceiving devices for communication via the cable;

at least one sensor configured to communicate signals via the communications system; and a closure mechanism configured to be positioned in a passageway defined by the wellbore, wherein the closure mechanism is configured to prevent a flow of fluid to a portion of the passageway that is closer to a surface of the wellbore than the closure mechanism.

12. The electric subsurface safety valve of claim 11, wherein the body further comprises a substructure adapted for storing a non-conductive fluid and wherein the communications system is disposed within the substructure and wherein the at least one sensor is disposed in the substructure.

13. The electric subsurface safety valve of claim 11, wherein the at least one sensor comprises a pressure sensor.

14. The electric subsurface safety valve of claim 11, wherein the at least one sensor comprises is configured to measure a pressure at a point in at least one of:

an annular space between the body and the wellbore;

the portion of the passageway that is closer to the surface of the wellbore than the closure mechanism; or an additional portion of the passageway that is further from the surface of the wellbore than the closure mechanism.

15. The electric subsurface safety valve of claim 11, wherein the at least one sensor comprises at least one proximity sensor configured to detect a proximity between the closure mechanism and the at least one proximity sensor, the at least one proximity sensor communicatively coupled to the processing device, wherein the processing device is further configured to determine a position of the closure mechanism based on the proximity between the closure mechanism and the at least one proximity sensor.

16. The electric subsurface safety valve of claim 11, wherein the processing device is configured to receive data from the at least one sensor and to autonomously configure one or more components of the electric subsurface safety valve in response to determining that the data describes a condition exceeding a threshold.

17. The electric subsurface safety valve of claim 11, further comprising at least one hydraulic port adapted to be coupled to a tool in the wellbore and to communicate fluid to the tool.

18. The electric subsurface safety valve of claim 11, further comprising at least one terminal adapted to be coupled to a tool in the wellbore, the at least one terminal configured to form an electrical connection for providing power received via the cable to the tool.

19. A system comprising a docking station; and an electric subsurface safety valve configured for being disposed in a wellbore through a fluid-producing formation, the electric subsurface safety valve comprising:

a body adapted to be coupled to a cable and to the docking station, wherein the body is further adapted to be disposed within the wellbore at a variable position in the wellbore;

a communications system embedded in the body, the communications system comprising:

one or more transceiving devices configured to communicate signals via the cable and to communicate signals wirelessly;

a processing device configured to process signals received by the one or more transceiving devices for communication via the cable; and a closure mechanism configured to be positioned in a passageway defined by the wellbore, wherein the closure mechanism is configured to prevent a flow of fluid to a portion of the passageway that is closer to a surface of the wellbore than the closure mechanism.

20. The system of claim 19, wherein the electric subsurface safety valve further comprises at least one terminal configured to form an electrical connection configured for providing power received via the cable to a tool coupled to the docking station.

21. The system of claim 20, wherein the docking station further comprises at least one additional terminal configured to form a second electrical connection to the tool via direct contact.

22. The system of claim 20, wherein the docking station further comprises at least one additional terminal configured to form a second electrical connection to the tool via inductive contact.

23. The system of claim 20, wherein the docking station further comprises an orientation mechanism adapted to orient the tool such that the tool can be coupled to the docking station.

24. The system of claim 23, wherein the orientation mechanism comprises at least one of a landing profile or a nipple profile.

25. The system of claim 19, wherein the docking station further comprises a power source configured to provide power to the docking station.

26. The system of claim 19, wherein the electric subsurface safety valve further comprises at least one terminal configured to form a data connection with the docking station configured for communicating data via the cable with a tool coupled to the docking station and wherein the docking station further comprises at least one additional terminal configured to form a second data connection with the tool.

27. The system of claim 26, wherein the tool comprises a recording device deployed via a wireline unit, wherein the recording device is configured to communicate video content to a control system at the surface of the wellbore via the at least one additional terminal.

28. The system of claim 26, wherein the tool is coupled to a second tool via a second cable, wherein the tool is configured to communicate data received via the at least one additional terminal to the second tool via the second cable.

29. The system of claim 26, wherein the tool comprises a shifting tool, wherein the shifting tool is configured to communicate data describing the position of a sleeve to a control system at the surface of the wellbore via the at least one additional terminal.

30. The system of claim 26, wherein the tool comprises a wireline tool deployed via a wireline unit, wherein the tool is configured to communicate status data to a control system at the surface of the wellbore via the at least one additional terminal.

31. The system of claim 30, wherein the wireline tool is further configured to perform a downhole operation in response to a control signal received from the control system via the at least one additional terminal.

32. The system of claim 31, wherein the wireline tool comprises at least one of a logging tool or a shifting tool.

* * * * *